United States Patent [19]

Guangorena

[11] 4,211,388

[45] Jul. 8, 1980

[54] REMOVABLE MAIN SHAFT RETAINER FOR DECK WINCH

[75] Inventor: Jesus Guangorena, Atherton, Calif.

[73] Assignee: Barient Company, Menlo Park, Calif.

[21] Appl. No.: 938,808

[22] Filed: Sep. 1, 1978

[51] Int. Cl.[2] ..... B66D 1/30

[52] U.S. Cl. ..... 254/344; 226/194; 254/323

[58] Field of Search ..... 254/150 R, 150 FH; 74/337, 337.5, 405; 114/111, 218; 226/194

[56] References Cited

U.S. PATENT DOCUMENTS

| | | | |
|---|---|---|---|
| 3,145,974 | 8/1964 | Short | 254/150 R |
| 3,281,120 | 10/1966 | Richardson | 254/150 R |
| 3,618,896 | 11/1971 | Bewley | 254/150 R |
| 3,910,557 | 10/1975 | Merriman | 254/150 R |

*Primary Examiner*—Edward J. McCarthy
*Attorney, Agent, or Firm*—Owen, Wickersham & Erickson

[57] ABSTRACT

A deck winch having provision for removal of the main shaft without removal of the winch base from the deck is disclosed. The winch includes a flat keeper member disposed radially to the main shaft and which seats semi-circumferentially in a circumferential groove in a main shaft. This keeper member is normally kept in the shaft-retaining position by the pinion shaft, which is spaced from the main shaft. An opening through the keeper member is positioned over the pinion shaft just above the upper gear and below a portion of the base structure, so that when the winch drum is removed and the pinion shaft is removed following extraction of a cotter pin, the keeper member may be easily pulled out to permit removal of the main shaft.

12 Claims, 5 Drawing Figures

REMOVABLE MAIN SHAFT RETAINER FOR DECK WINCH

BACKGROUND OF THE INVENTION

The invention relates to deck winches, and more particularly to an improved winch having provision for removal of the main shaft for maintenance or repair without detachment of the winch base from the deck.

Previously, deck winches have had to be removed in their entirety from a deck in order to pull the main shaft. This was due to the fact that the retaining structure for keeping the shaft in place to prevent upward movement was typically a clip device coacting between a groove in the main shaft, near its bottom, and a portion of the winch base surrounding the main shaft near the lower end. The clip device was accessible only from the underside of the winch base, so that the base itself had to be removed to release the shaft.

This situation was objectionable in that a great deal of time was required to perform any maintenance or replacement functions on the main shaft. One would normally be required to remove the winch drum, then remove a series of bolts circumferentially positioned around the winch base and passing through the vessel deck, then invert the inner winch structure to release the clip to permit the shaft's removal. In some situations, the bolts would be difficult to remove because the bolt heads would be below the deck and would have to be held. Of course, replacement of the winch on the deck following the main shaft's maintenance operation was also time consuming and sometimes difficult.

SUMMARY OF THE INVENTION

The present invention provides a relatively simple, convenient and dependable means for eliminating the requirement that the winch base be removed from the deck for access to the main shaft. The main shaft is again retained by means of a circumferential groove near its lower end, but coacting with this groove is a flat keeper member which is readily accessible after removal of the winch drum. The keeper member seats in the groove and is radially disposed with respect to the shaft, with a bore which is positioned over the winch's pinion shaft, stacked on the pinion shaft along with the pinion-mounted gears. The keeper is preferably located above the upper pinion gear and below a portion of the base structure, so that it is firmly retained against up and down as well as lateral movement. The pinion shaft is retained against upward movement only by a fastener such as a cotter pin, which may be quickly removed following the drum's removal so that the pinion shaft can be uplifted from the gears and the base. The pinion gears may be then slipped outwardly, giving access to the keeper member.

This arrangement provides for quick and easy removal of the main shaft, utilizing a relatively simple and inexpensively produced apparatus. With its utilization of the pinion assembly, the removable retaining structure of the invention results in secure retention of the keeper member from movement in all directions, avoidance of unnecessary wear and avoidance of any additional openings in the base structure beyond that which is already required for the pinion gears, one of which meshes with the internal gear teeth of the drum.

In a preferred embodiment of the invention, the removable main shaft retaining means for a deck winch comprises a circumferential ridge on the main shaft, a generally flat keeper member horizontally within the winch, having a retaining edge engaging the main shaft, positioned above the upper side of the main shaft ridge in the assembled winch, and means associated with the pinion assembly for retaining the keeper member in position in engagement with the main shaft when the winch is assembled, and for permitting removal of the keeper member when the drum is removed.

Accordingly, it is among the objects of the invention to provide an improved main shaft retaining means for a deck winch, wherein the shaft retaining structure is easily accessible without removal of the winch base from the deck, and wherein complex structure and radical changes to conventional winch structure are avoided. These and other objects, advantages and features of the invention will be apparent from the following description of a preferred embodiment, taken in conjunction with the accompanying drawings.

DESCRIPTION OF A PREFERRED EMBODIMENT

Figure 1:
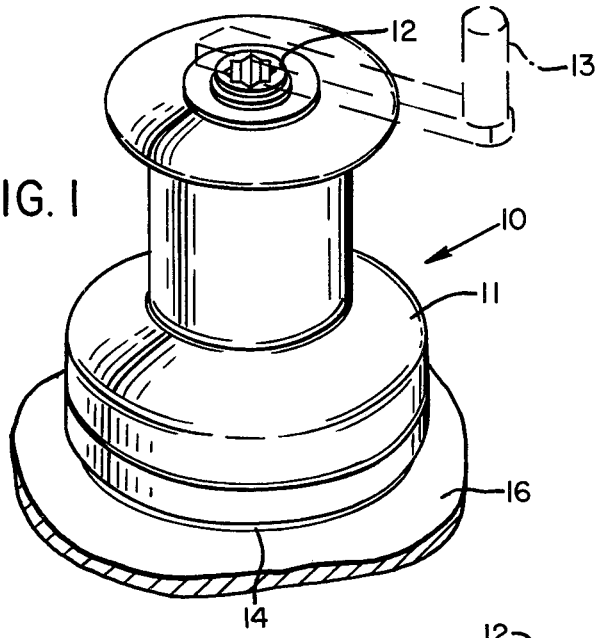
FIG. 1 is a perspective view of an assembled deck winch secured to a portion of a deck.

FIG. 1 shows a deck winch 10 including a winding drum 11, a centrally positioned main shaft 12 driven by a crank handle 13 (phantom), and a base 14 securred to a portion of a vessel deck 16.

Figure 2:
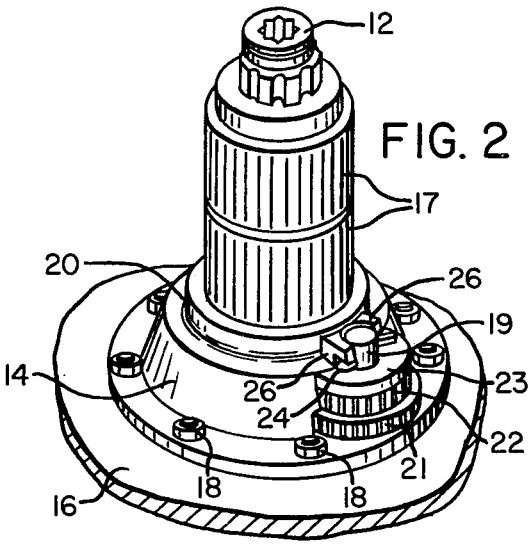
FIG. 2 is a perspective view of the winch with the winding drum removed.

FIG. 2 shows the deck winch 10 with the crank handle 13 and winding drum 11 removed, exposing the drum bearings 17, more of the base 14, including an upper portion 20, bolts 18 retaining the base to the deck 16, and a pinion shaft 19 about which two or more pinion gears 21 and 22 are positioned. A ledge or flange 23 of the base extends over the gears 21 and 22, and the pinion shaft 19 extends through this ledge to be retained in position by a cotter pin or other readily removable fastener 24 passing through the pinion shaft and through one or more flanges 26 extending into proximity with the pinion shaft.

Figure 3:
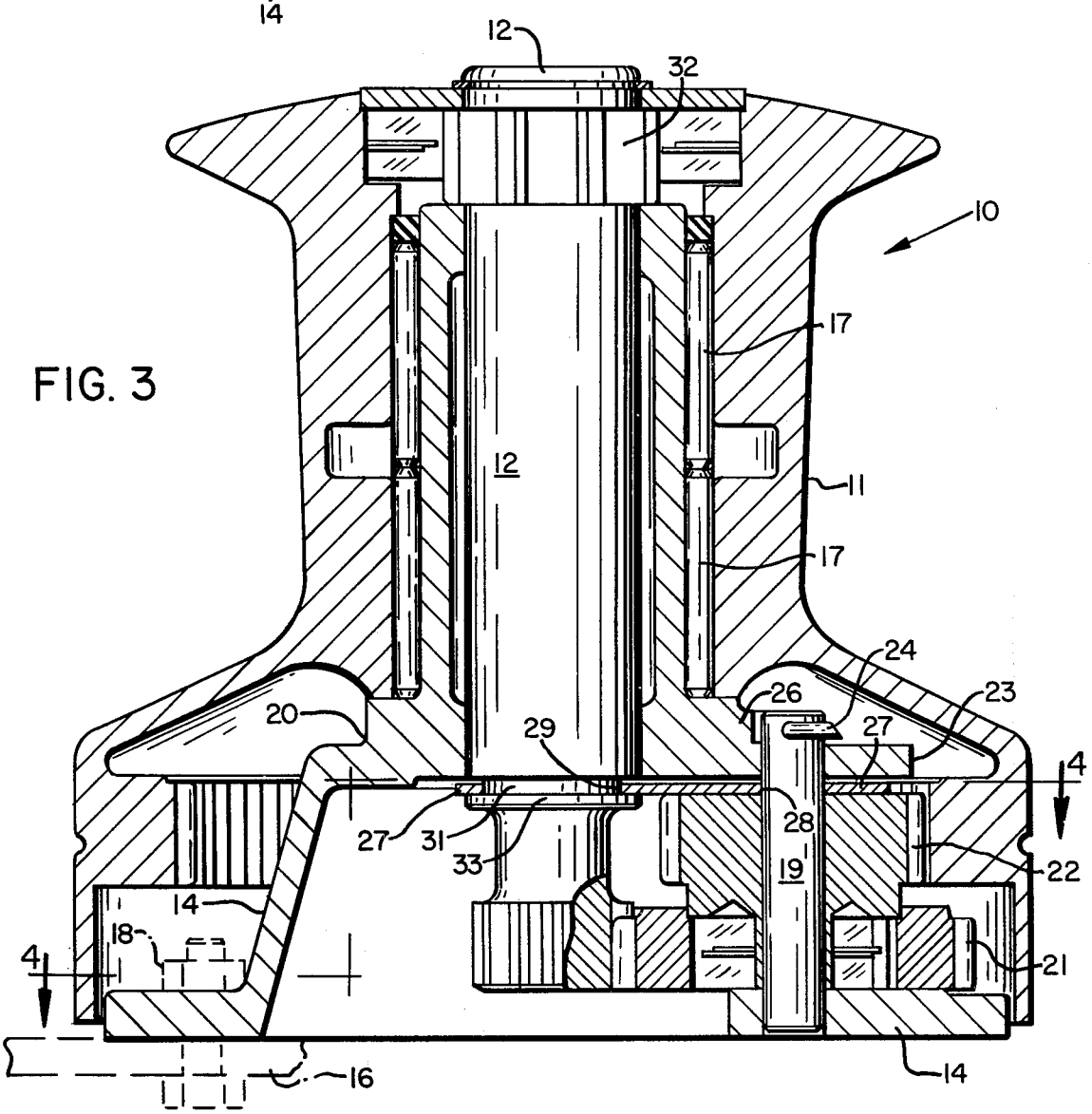
FIG. 3 is a sectional view of the assembled winch showing the removable shaft retainer arrangement according to the invention.

FIG. 3 is a larger sectional view of the assembled winch, showing a preferably flat keeper member 27 positioned between the ledge 23 of the base portion 20 and the upper pinion mounted gear 22, the member 27 having a bore 28 positioned over the pinion shaft 19 in stacked relationship with the gears 21 and 22. Although the keeper member 27 is shown above the uppermost gear 22, it could alternatively be positioned between gears, if desired.

Figure 4:
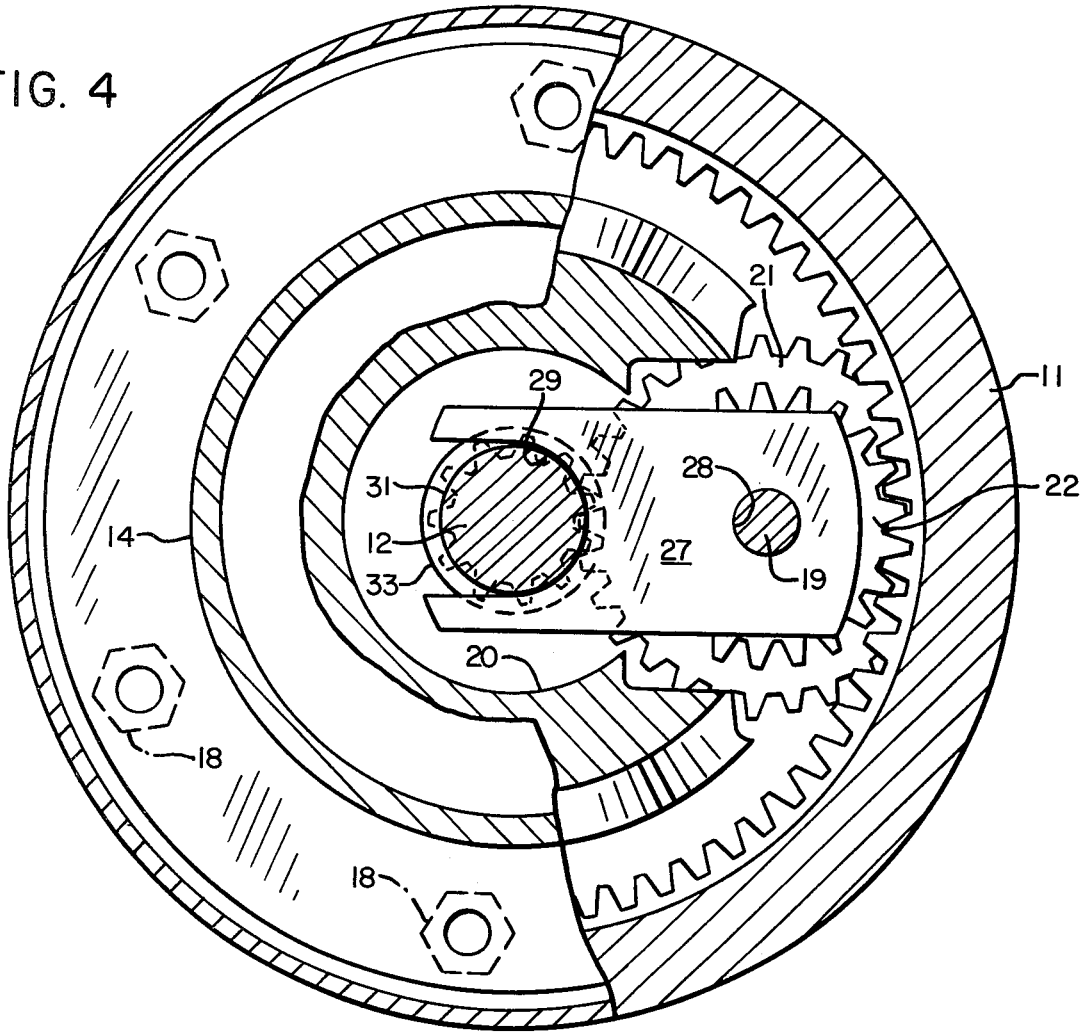
FIG. 4 is a sectional view looking down on a portion of the retainer structure, taken along the line 4—4 of FIG. 3.

The keeper member, shown in plan view in FIG. 4, has a retaining edge 29 which engages and is seated within a circumferential groove 31 in the main shaft 12 in the assembled winch, to normally prevent the uplifting of the main shaft. Other structure above, such as a collar 32 near the top of the shaft 12, preferably holds the shaft in position against downward movement; thus, the most important portion of the groove 31 is a circumferential ridge 33 forming its lower boundary, and against which the keeper member 27 acts in restraint of forces which would tend to lift the main shaft 12.

The retaining edge 29 of the keeper member 27 is preferably arcuate and may extend nearly semi-circumferentially around the shaft groove 31 as indicated in FIGS. 3 and 4, to maximize the arc of its retention, to provide for convenience in the insertion of the keeper and to provide an efficient and simple mechanism by which the keeper is prevented from rotation about the pinion shaft 19. This further adds to the simplicity and overall convenience of the removable shaft retainer structure of the invention.

Figure 5:
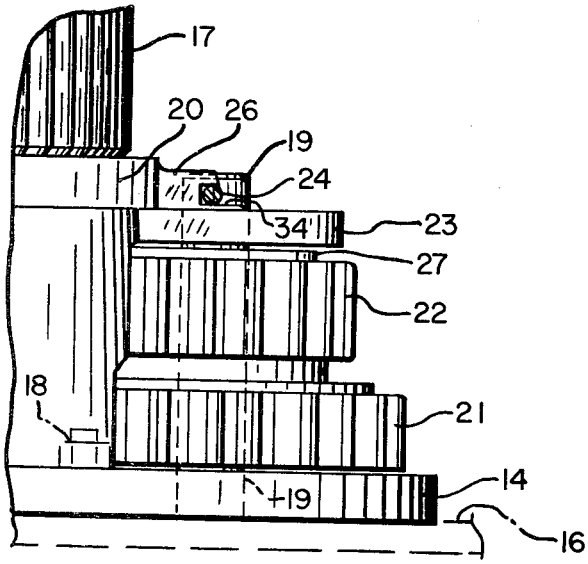
FIG. 5 is an elevational view showing the manner in which the pinion shaft is retained for convenient removal.

FIG. 5 further illustrates the means by which the pinion shaft 19 is retained in the base 14. The cotter pin retaining flanges 26 which extend outwardly from the base 14 preferably on both sides of the pinion shaft 19 may extend just far enough along side the pinion shaft 19 to engage the cotter pin 24. Thus, the flanges may include open ended notches 34 as shown, rather than bores, in which the cotter pin resides.

The above described preferred embodiment provides a deck winch having a very efficient structure for retaining the main shaft in place in such a way that it may be readily removed without detachment of the winch base from the deck of the vessel. The retainer is designed such that it fits in with existing components in a typical multiple-speed winch, requiring very few changes from the typical internal structure of a winch, while also being extremely convenient in operation. Various other embodiments and variations to this preferred embodiment will be apparent to those skilled in the art and may be made without departing from the spirit and scope of the following claims.

I claim:

1. In a deck winch having a base, a main shaft disposed centrally within the base, a pinion assembly including a pinion shaft mounted in the base and a plurality of gears disposed about the pinion shaft, and an exterior drum driven by the pinion assembly, an improved main shaft retaining means permitting removal of the main shaft without removing the winch from the deck, comprising:

a circumferential ridge on the main shaft;

a generally flat keeper member oriented horizontally within the winch, having a retaining edge engaging the main shaft, positioned above the upper side of the main shaft ridge in the assembled winch; and means associated with the pinion assembly for retaining the keeper member in position in engagement with the main shaft when the winch is assembled, and for permitting removal of the keeper member after the drum is removed.

2. The deck winch of claim 1 wherein said means comprises engagement means on the keeper member for engagement against the pinion shaft, with the keeper member retained between the main and pinion shafts, and releasable pinion shaft retaining means providing for removal of the pinion shaft after the drum is removed.

3. The deck winch of claim 2 wherein said engagement means comprises a bore through the keeper member with the pinion shaft therethrough, said keeper member being stacked on the pinion shaft adjacent to one of said gears.

4. The deck winch of claim 3 wherein the keeper member is positioned between the uppermost gear on the pinion shaft and a portion of the base above.

5. The deck winch of claim 3 wherein said releasable pinion shaft retaining means comprises a flange of the base extending into proximity with the upper end of the pinion shaft, and removable fastening means passing through the flange and the pinion shaft to retain the pinion shaft in place, whereby, after removal of the drum, the fastening means may be removed, the pinion shaft may be lifted from the base, and the keeper member may be pulled out from engagement with the main shaft.

6. The deck winch of claim 2 wherein said releasable pinion shaft retaining means comprises a flange of the base extending into proximity with the upper end of the pinion shaft, and removable fastening means passing through the flange and the pinion shaft to retain the pinion shaft in place.

7. The deck winch of claim 2 wherein said retaining edge on the keeper member is generally semicircular, engaging the main shaft in an arc of about 180°.

8. The deck winch of claim 2 wherein said circumferential ridge on the main shaft comprises the lower portion of a groove within which the retaining edge is seated.

9. The deck winch of claim 2 wherein the pinion shaft is positioned in bores of spaced lower and upper portions of the base, extending above the upper base portion, said releasable pinion shaft retaining means comprising a flange of the base extending adjacent to the upper end of the pinion shaft and a removable cotter pin passing through the flange and the pinion shaft, and wherein the keeper member is positioned between the uppermost gear on the pinion shaft and said upper base portion above, maintaining the keeper member in horizontal alignment in proper registry with the main shaft ridge.

10. The deck winch of claim 9 wherein said engagement means comprises a bore through the keeper member with the pinion shaft therethrough.

11. The deck winch of claim 10 wherein said retaining edge on the keeper member is generally semicircular, engaging the main shaft in an arc of about 180°.

12. The deck winch of claim 11 wherein said circumferential ridge on the main shaft comprises the lower portion of a groove within which the retaining edge is seated.

* * * * *